US008290398B2

(12) United States Patent
Nishiyama

(10) Patent No.: US 8,290,398 B2
(45) Date of Patent: Oct. 16, 2012

(54) AGITATING MEMBER AND DEVELOPING CARTRIDGE

(75) Inventor: Hideshi Nishiyama, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 628 days.

(21) Appl. No.: 12/555,282

(22) Filed: Sep. 8, 2009

(65) Prior Publication Data

US 2010/0080630 A1 Apr. 1, 2010

(30) Foreign Application Priority Data

Sep. 29, 2008 (JP) ..... 2008-250539

(51) Int. Cl.
*G03G 15/06* (2006.01)

(52) U.S. Cl. ..... 399/119; 399/107; 399/254

(58) Field of Classification Search ..... 399/119, 399/107, 254
See application file for complete search history.

(56) References Cited

U.S. PATENT DOCUMENTS 6,337,956 B1 1/2002 Sato et al.
7,224,925 B2 * 5/2007 Sato et al. ..... 399/263
7,529,508 B2 * 5/2009 Choi et al. ..... 399/256
7,924,299 B2 * 4/2011 Kishi ..... 347/140
2006/0238599 A1 10/2006 Kishi et al.

FOREIGN PATENT DOCUMENTS

JP 2000-258985 9/2000
JP 2006-308688 11/2006

* cited by examiner

*Primary Examiner* — Dameon E Levi
*Assistant Examiner* — Thomas Giampaolo, II
(74) *Attorney, Agent, or Firm* — Scully, Scott, Murphy & Presser, PC

(57) ABSTRACT

In order to provide an agitator having a wiper made of a resiliency deformable material, an agitator according to an embodiment of the present invention includes a main body and a resiliently deformable plate-like member. The main body has a placing surface, a first protrusion, and a second protrusion protruding from the placing surface. The resiliently deformable plate-like member has a free end portion including a free end and a supported portion supported to the main body, the supported portion being placed on the placing surface and having a first engaging section engaging the first protrusion and a second engaging section engaging the second protrusion, the supported portion being curved upon resilient deformation thereof as a result of engagement of the first engaging section and the second engaging section with the first protrusion and the second protrusion respectively, a length between the first engaging section and the second engaging section being greater than a linear distance between the first protrusion and the second protrusion.

12 Claims, 6 Drawing Sheets

AGITATING MEMBER AND DEVELOPING CARTRIDGE

CROSS REFERENCE TO RELATED APPLICATION

This application claims priority from Japanese Patent Application No. 2008-250539 filed Sep. 29, 2008. The entire content of the priority application is hereby incorporated by reference in its entirety.

TECHNICAL FIELD

The present invention relates to an agitator, and also to a developing cartridge provided with the agitator.

BACKGROUND

A conventional electrophotographic image forming device is provided with a photosensitive drum on which electrostatic latent images are formed, and a developing cartridge that develops the electrostatic latent images. The developing cartridge is formed with a toner accommodation chamber for accommodating toner. An agitator is provided within the toner accommodation chamber for agitating the toner therein. A window for detecting residual amounts of toner is formed in a side wall of the toner accommodating chamber, and the agitator is provided with a wiper for cleaning the window.

In this developing cartridge, the agitator is provided with a fixing member to which the wiper is fixed. Specifically, the fixing member includes a supporting plate and a clamping plate disposed in opposition to each other. The supporting plate is formed with a boss protruding toward the clamping plate. The wiper is formed of an elastic material such as a urethane rubber, and has an end portion formed with a through-hole corresponding to the boss. The wiper is inserted into a slit formed between the supporting plate and the clamping plate, and the boss is then inserted to penetrate the through-hole, thereby fixing the wiper to the fixing member.

For the sake of reducing costs in manufacturing the wiper, a resiliently deformable plate-like member made from a synthetic resin may be employed as a material, instead of an elastic material.

When an elastic material is employed as a material of the wiper, even though the through-hole has a diameter smaller than that of the boss, the diameter of the through-hole can be expanded so that the boss can penetrate the through-hole because of the elasticity. On the other hand, if a resiliently deformable plate-like member is used as a material of the wiper, the through-hole needs to have a greater diameter than the boss in order to enable the boss to reliably penetrate the through-hole. Therefore, the fixation between the resiliently deformable plate-like member and the fixing member may become loose, leading to lower positioning accuracy of the resiliently deformable plate-like member relative to the fixing member.

SUMMARY

In view of the forgoing, it is an object of the present invention to provide an agitator in which a resiliently deformable plate-like member can be fixedly secured to a main body of the agitator avoiding loose fixing, thereby realizing improved positioning accuracy of the resiliently deformable plate-like member against the main body of the agitator. The present invention also aims to provide a developing cartridge provided with such agitator.

In order to achieve the above and other objects, the present invention provides an agitator for agitating developer that includes a main body and a resiliently deformable plate-like member. The main body has a placing surface, a first protrusion, and a second protrusion protruding from the placing surface. The resiliently deformable plate-like member has a free end portion including a free end and a supported portion supported to the main body, the supported portion being placed on the placing surface and having a first engaging section engaging the first protrusion and a second engaging section engaging the second protrusion, the supported portion being curved upon resilient deformation thereof as a result of engagement of the first engaging section and the second engaging section with the first protrusion and the second protrusion, respectively, a length between the first engaging section and the second engaging section being greater than a linear distance between the first protrusion and the second protrusion.

According to another aspect of the present invention, there is provided a developing cartridge for accommodating developer. The developing cartridge includes a casing that accommodates the developer, and an agitator disposed within the casing for agitating the developer. The agitator includes a main body and a resiliently deformable plate-like member. The main body has a placing surface, a first protrusion, and a second protrusion protruding from the placing surface. The resiliently deformable plate-like member has a free end portion including a free end and a supported portion supported to the main body, the supported portion being placed on the placing surface and having a first engaging section engaging the first protrusion and a second engaging section engaging the second protrusion, the supported portion being curved upon resilient deformation thereof as a result of engagement of the first engaging section and the second engaging section with the first protrusion and the second protrusion, respectively, a length between the first engaging section and the second engaging section being greater than a linear distance between the first protrusion and the second protrusion.

DETAILED DESCRIPTION

Figure 1:
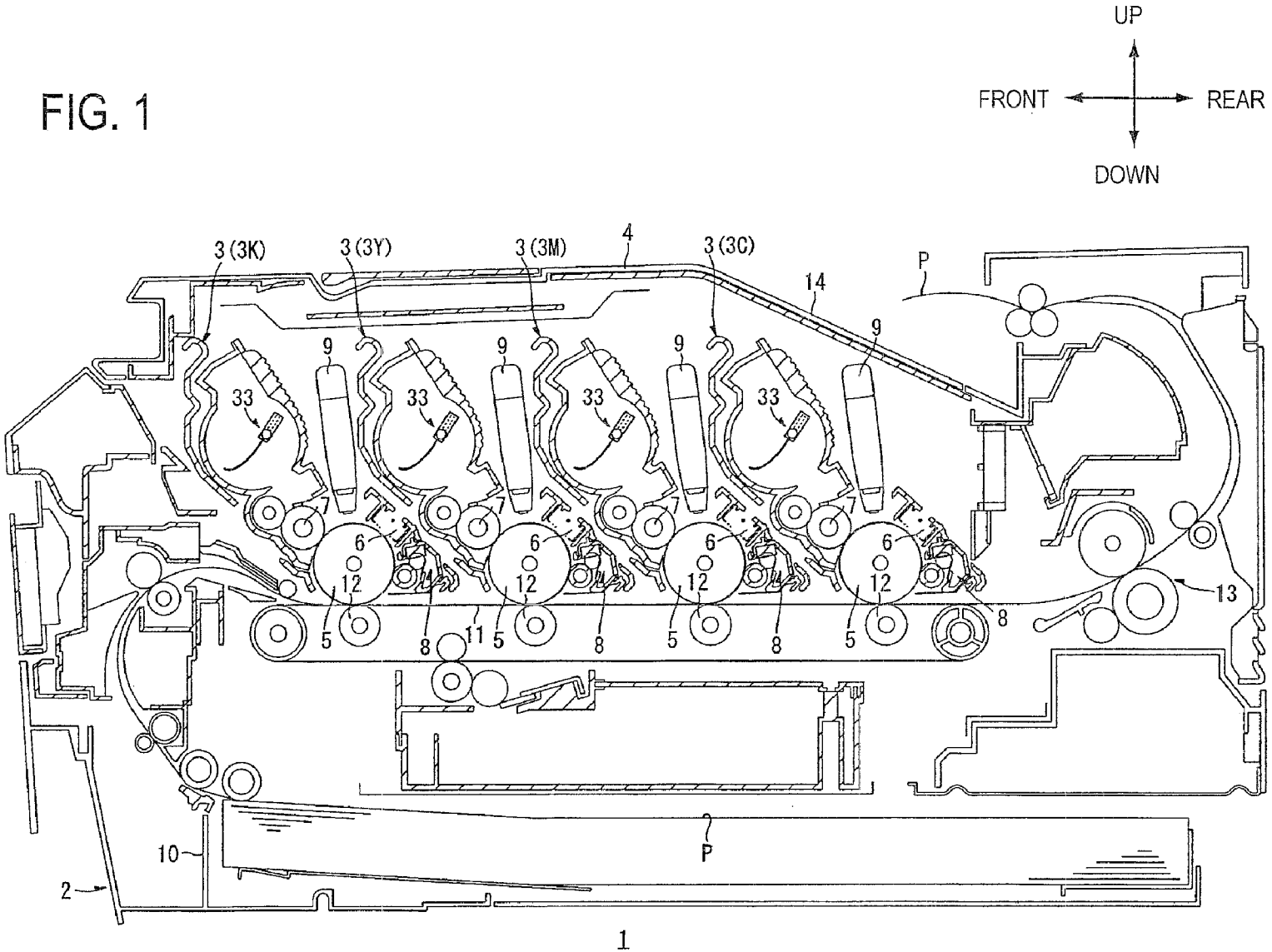
FIG. 1 is a cross-sectional view of a printer installing process cartridges according to a first embodiment of the present invention.

First, a general configuration of a printer 1 installing process cartridges according to a first embodiment of the present invention will be described with reference to FIG. 1. Note that, throughout the description, left and right sides of the printer 1 will be designated assuming that the printer is seen from the front side thereof. A left-to-right direction will also be referred to as a "widthwise direction". Unless otherwise stated, orientations in drawings will be referred to as shown in the drawings.

The printer 1 is a color printer and used here as an example of image forming devices. As shown in FIG. 1, the printer 1 includes a main casing 2 whose upper surface is provided with a top cover 4. Within the main casing 2, four process cartridges 3 are provided. The four process cartridges 3 respectively correspond to four colors (black, yellow, magenta and cyan) and thus are individually referred to as process cartridges 3K, 3Y, 3M and 3C. The four process cartridges 3K, 3Y, 3M and 3C are juxtaposed at intervals in a sheet conveying direction (to be described later). More specifically, the process cartridges 3K, 3Y, 3M and 3C are arranged in the sheet conveying direction from upstream in this order. Each of the four process cartridges 3 is detachably mounted in the main casing 2 from above when the top cover 4 is opened.

Each process cartridge 3 includes a photosensitive drum 5, a Scorotron charger 6, a developing roller 7 and a cleaning unit 8. The charger 6, the developing roller 7 and the cleaning unit 8 are disposed within the process cartridge 3 such that each of the charger 6, the developing roller 7 and the cleaning unit 8 opposes the photosensitive drum 5.

Within the main casing 2, four LED units 9 for each color are disposed in correspondence to the four process cartridges 3. Each LED unit 9 includes LEDs and has an end portion facing toward the corresponding photosensitive drum 5.

In accordance with rotation of each photosensitive drum 5, each Scorotron charger 6 uniformly charges the surface of the corresponding photosensitive drum 5. The LEDs provided on the end portion of each LED unit 9 then irradiate the surface of the corresponding photosensitive drum 5, thereby forming an electrostatic latent image thereon based on image data. When the photosensitive drum 5 continues to rotate and the electrostatic latent image opposes the corresponding developing roller 7, toner is supplied onto the electrostatic latent image, thereby forming a toner image on the surface of the photosensitive drum 5.

In a bottom portion of the main casing 2, a sheet cassette 10 is disposed for accommodating sheets P. The sheets P accommodated in the sheet cassette 10 are conveyed onto a conveying belt 11 via a variety of rollers. The conveying belt 11 is an endless belt having an upper portion opposing each of the four photosensitive drums 5 from the bottom thereof. A transfer roller 12 is also disposed in opposition to each of the photosensitive drums 5 from the bottom thereof so that each photosensitive drum 5 and the corresponding transfer roller 12 can nip the upper portion of the conveying belt 11 therebetween. Each sheet P conveyed to the conveying belt 11 passes between the conveying belt 11 and each photosensitive drum 5 along with the movement of the conveying belt 11. At this time, the toner image formed on the surface of each photosensitive drum 5 is transferred onto the sheet P because of a transfer bias applied to the transfer roller 12. Note that, a direction in which the sheet P is conveyed by the conveying belt 11 will be referred to as a "sheet conveying direction" and the sheet conveying direction extends from a front side to a rear side of the printer 1, as shown in FIG. 1. Hence, upstream in the sheet conveying direction represents the front side (forward), while downstream in the sheet conveying direction represents the rear side (rearward) in the printer 1.

A fixing unit 13 is disposed downstream of the conveying belt 11 in the sheet conveying direction. The sheet P on which the toner image has been transferred is then conveyed to the fixing unit 13. In the fixing unit 13, the toner image is fixed on the sheet P with heat and pressure applied thereto. Finally, the sheet P having the toner image fixed thereon is discharged onto a discharge tray 14 formed on the upper surface of the main casing 2 via a range of rollers.

After the toner image is transferred onto the sheet P from each photosensitive drum 5, toner remaining on the surface of each photosensitive drum 5 and paper dust of the sheet P deposited thereon are removed by the respective cleaning unit 8 when each photosensitive unit 5 faces the corresponding cleaning unit 8 in accordance with further rotation of the photosensitive drum 5.

Figure 2:
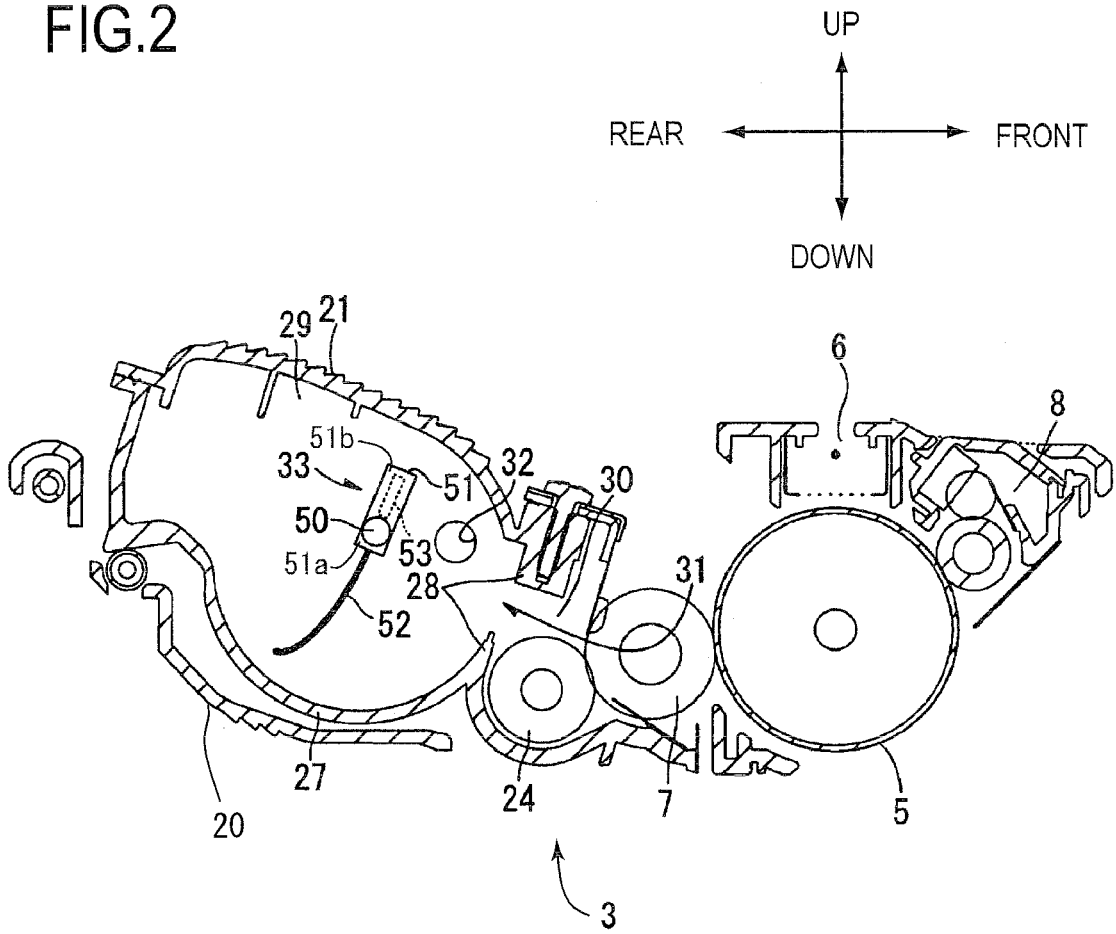
FIG. 2 is a central cross-sectional view of a process cartridge according to the first embodiment.

Next, a general configuration of the process cartridge 3 will be described with reference to FIG. 2.

Each process cartridge 3 includes a box-shaped frame 20 having an open upper surface. The photosensitive drum 5, the Scorotron charger 6 and the cleaning unit 8 are retained within the frame 20. The photosensitive drum 5 is rotatably supported to the frame 20 and has a circumferential surface partially exposed from the frame 20 toward below and forward.

A developing cartridge 21 is detachably mounted in the frame 20 at a position rearward of the photosensitive drum 5. The developing cartridge 21 further includes a box-shaped developing casing 27 having an open front portion. A partitioning wall 28 is provided midway in the developing casing 27 with respect to the front-to-rear direction for partitioning the interior of the developer casing 27 into a toner hopper 29 and a developing unit 30. As shown in FIG. 2, the developing unit 30 is located forward of the toner hopper 29 and includes a supply roller 24 and the developing roller 7. A through-hole 31 is formed in the partitioning wall 28 to allow communication between the toner hopper 20 and the developing unit 30.

The toner hopper 29 accommodates toner corresponding to one of the four colors as a developer. Windows 32 are formed in both side walls of the developing casing 27 at positions opposing to each other in the widthwise direction across the front portion of the toner hopper 29. Each window 32 is configured of a transparent circular plate fitted in a circular through-hole formed in the side wall of the developing casing 27.

Note that, a toner empty sensor (not shown) is provided in the main casing 2. When the process cartridge 3 (developing cartridge 21) is mounted in the main casing 2, the toner empty sensor includes a light emitting element disposed at a position opposing one of the windows 32 and a light receiving element disposed at a position opposing the other window 32. A detection light emitted from, fee light emitting element enters into the toner hopper 29 through one of the windows 32, passes within the toner hopper 29, exits out of the other window 32, and is finally received by the light receiving element. In this way, while the toner accommodated within the toner hopper 29 is being agitated by an agitator 33 (to be described next), measuring the detection light received by the light receiving element allows a user to detect how much toner is left in the toner hopper 29.

An agitator 33 is provided within the toner hopper 29 for agitating the toner as an example of agitating members. The agitator 33 includes a rotational shaft 50 and a main body 51 (See FIG. 3). The rotational shaft 50 extends in the widthwise direction and is rotatably supported to the side walls of the developing casing 27 at a position substantially center of the toner hopper 29. The main body 51 represents an example of agitator main bodies. The main body 51 extends in an axial direction of the rotational shaft 50 and protrudes radially outwardly from diametrically opposite sides (hereinafter will be referred to as a first portion 51*a* and a second portion 51*b* as shown in FIG. 2) of the rotational shaft 50. When the rotational shaft 50 rotates, the main body 51 circularly moves about an axis of the rotational shaft 50 in conjunction with the rotation of the rotational shaft 50.

Figure 3:
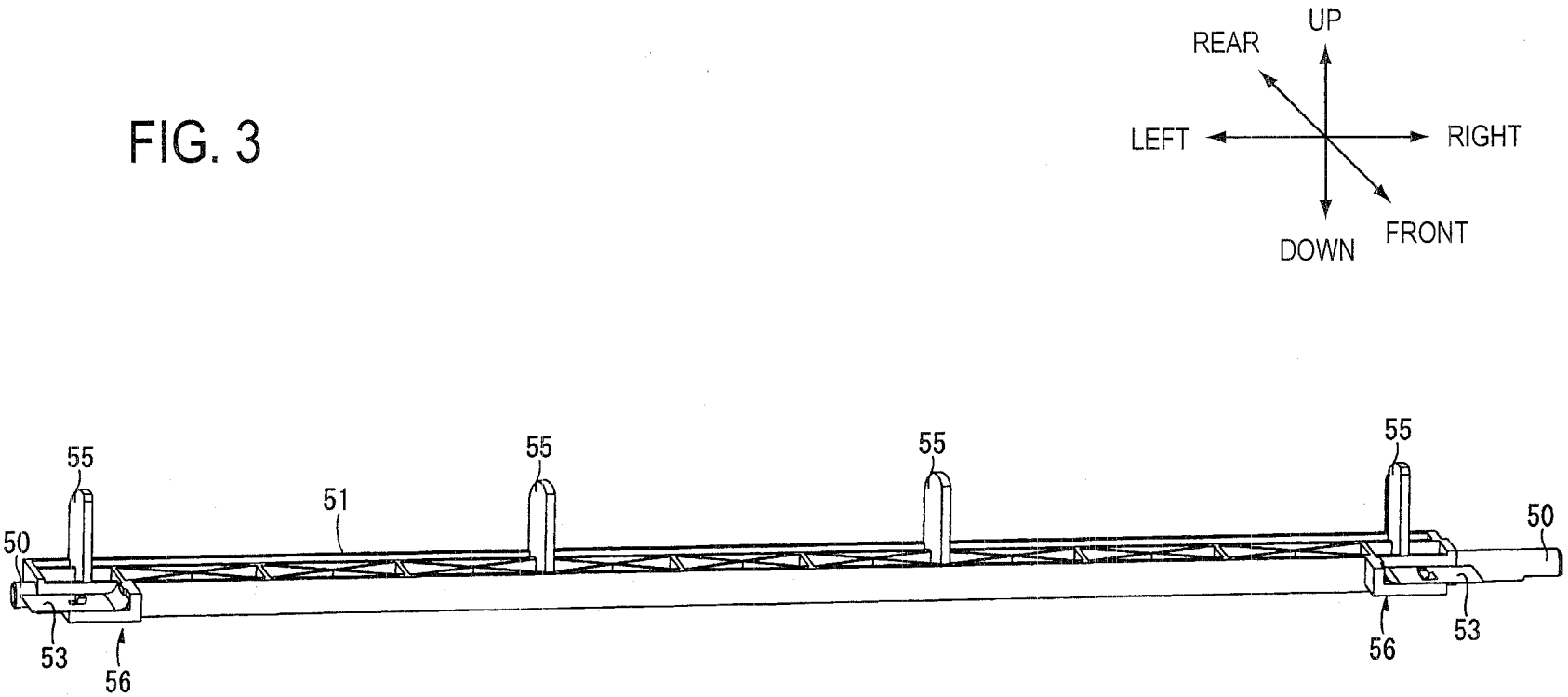
FIG. 3 is a perspective view of an agitator in the process cartridge according to the first embodiment as viewed from upward and leftward front.

The main body 51 of the agitator 33 includes an agitating blade 52 and wipers 53. The agitating blade 52 is disposed at a radial end of the first portion 51*a* of the main body 51. The wipers 53, as an example of resiliently deformable plate-like members, are provided at both widthwise ends of the second portion 51*b* of the main body 51, as shown in FIG. 3.

The rotational shaft 50 rotates upon receipt of driving force. The main body 51 then starts to move about the axis of the rotational shaft 50 within the toner hopper 29. Along with the movement of the main body 51, the agitating blade 52 agitates the toner accommodated in the toner hopper 29. At the same time, the wipers 53 rub internal surfaces of the windows 32, thereby cleaning the window 32. That is, toner deposited on inner surfaces of the windows is wiped out.

In the developing unit 30, the developing roller 7 is formed in a cylindrical-shape, extending in the widthwise direction. The developing roller 7 is disposed such that the circumferential surface thereof is outside of the developing casing 27. When the developing cartridge 21 is mounted in the frame 20, a portion of the circumferential surface of the developing roller 7 exposed from the developing casing 27 is in contact with the rear circumferential surface of the photosensitive drum 5.

The supply roller 24 also has a cylindrical shape, extending in the widthwise direction. The supply roller 24 is disposed at a position forward and adjacent to the through-hole 31 of the developing unit 30. The supply roller 24 contacts the developing roller 7 from below and rearward.

The toner agitated by the agitator 33 is supplied onto the surface of the supply roller 24 via the through-hole 31. When the supply roller 24 and the developing roller 7 rotate, the toner is then supplied onto the surface of the developing roller 7 from the supply roller 24.

Next, a detailed configuration of the agitator 33 and a method of fixing the wiper 53 to the agitator 33 will be described with reference to FIGS. 3 to 7B. Note that, the agitating blade 52 is not shown in each drawing after FIG. 3 for the sake of simplification.

A configuration of the agitator 33 will first be described. As described earlier, the agitator 33 includes the rotational shaft 50 and the main body 51. As shown in FIG. 3, the main body 51 extends in the axial direction of the rotational shaft 50 (i.e., in the widthwise direction), as well as in the radial direction of the rotational shaft 50 (i.e., the front-to-rear direction in FIG. 3). The main body 51 is formed in a plate shape having a grid structure therein.

The main body 51 includes four shielding plates 55 and two fixing members 56. Each shielding plate 55 is formed in a plate shape having major surface extending in a vertical plane. Four shielding plates 55 are provided on a radially extending surface of the main body 51 and arranged in the widthwise direction at an equi-interval. The shielding plates 55 are adapted to block the detection light of the toner empty sensor at a predetermined interval, thereby enhancing accuracy in detecting residual amounts of the toner.

Two fixing members 56 are respectively provided on widthwise ends of the main body 51. The fixing members 56 protrude radially outward from a radial end surface (i.e., front surface in FIG. 3) of the second portion 51*b* of the main body 51. The wipers 53 are fixed onto the fixing members 56. Note that, the wipers 53 and the fixing members 56 have symmetrical structures in the main body 51. Hence, a description will be given hereinafter only on the wiper 53 and the fixing member 56 located leftward.

Figure 4A:
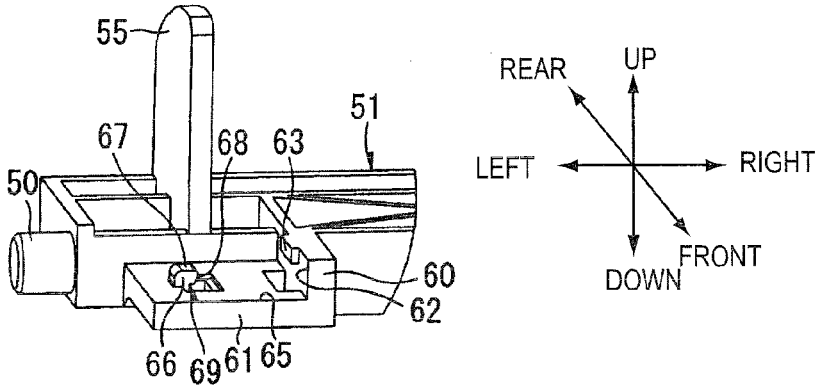
FIG. 4A is an enlarged perspective view of a fixing member including a second protrusion provided in the agitator.
Figure 4B:
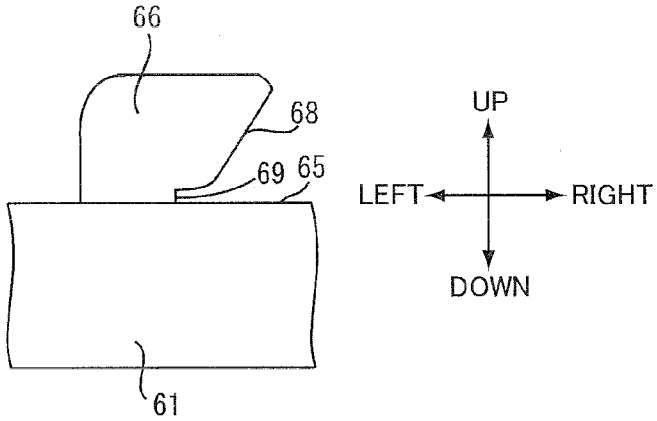
FIG. 4B is an enlarged cross-sectional view of the second protrusion of the fixing member as viewed from front.

As shown in FIG. 4, the fixing member 56 is substantially L-shaped in a side view. More specifically, the fixing member 56 integrally includes a first fixing portion 60 and a second fixing portion 61 that protrude radially outward from the radially one end surface of the main body 51. The first fixing portion 60 has a height substantially the same as that of the main body 51, and has a substantially rectangular side view. The second fixing portion 61 extends leftward from a bottom portion of the first fixing portion 60 and has a substantially rectangular shape in a planar view.

A left-side surface 62 of the first fixing portion 60 serves as a wiper engaging surface which the wiper 53 engages, as will be described later. The wiper engaging surface 62 has an upper end portion protruding leftward, which serves as a first protrusion 63.

The first protrusion 63 is formed in a substantially rectangular shape in a side view, and has a bottom end surface orienting in a direction substantially orthogonal to the wiper engaging surface 62.

The second fixing portion 61 has an upper surface 65 serving as a wiper placing surface 65 on which the wiper 53 is placed, as will also be described later. The wiper placing surface 65 and the wiper engaging surface 62 are perpendicular to each other. A second protrusion 66 is formed at a position substantially center of the wiper placing surface 65 and protrudes upward therefrom.

The second protrusion 66 is formed with a hook 67 protruding rightward from an upper right end surface of the second protrusion 66. The hook 67 has a right end surface 68 sloping diagonally upward and rightward. A gap 69 is formed between a bottom end surface of the sloped surface 68 and the wiper placing surface 65.

Figure 5:
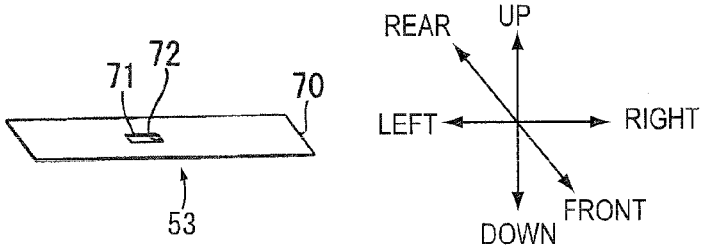
FIG. 5 is a perspective view of a wiper.

The wiper 53 is a plate-like member made of a synthetic resin such as PET, instead of a rubber. Hence, production costs of the wiper 53 can be cut down. As shown in FIG. 5, the wiper 53 is formed in a substantially rectangular shape in a planar view, extending in the left-to-right direction. The wiper 53 has a width in the front-to-rear direction substantially identical to that of the wiper placing surface 65 in the front-to-rear direction. The wiper 53 has a length in the widthwise direction longer than a sum of a height of the wiper engaging surface 62 in the vertical direction and a length of the wiper placing surface 65 in the widthwise direction. Hence, as will be describe later, when the wiper 53 is fixed to the fixing member 56, a left end portion of the wiper 53 is not fixed to the wiper placing surface 65, thereby becoming a free end. While the agitator 33 rotates, the free end of the wiper 53 slidingly contacts the windows 32. In this way, the toner adherent, to the windows 32 can be removed therefrom, thereby allowing the amounts of toner to be detected with high accuracy.

The wiper 53 is formed with a slot 71. The slot 71 is substantially rectangular-shaped, extending in the widthwise direction. The slot 71 has a width in the front-to-rear direction substantially identical to that of the second protrusion 66, and a length in the widthwise direction longer than that of the second protrusion 66. The slot 71 is formed in such a position that a distance between a right end 72 of the slot 71 in the widthwise direction and a right end surface 70 of the wiper 53 be longer than a linear distance between the first protrusion 63 and the second protrusion 66, before the wiper 53 is fixed to the fixing member 56. The right end surface 70 serves as a first engaging section, as will be described later.

A method for fixing the wiper 53 to the fixing member 56 will now be described mainly with reference to FIGS. 6A through 7B.

Figure 6A:
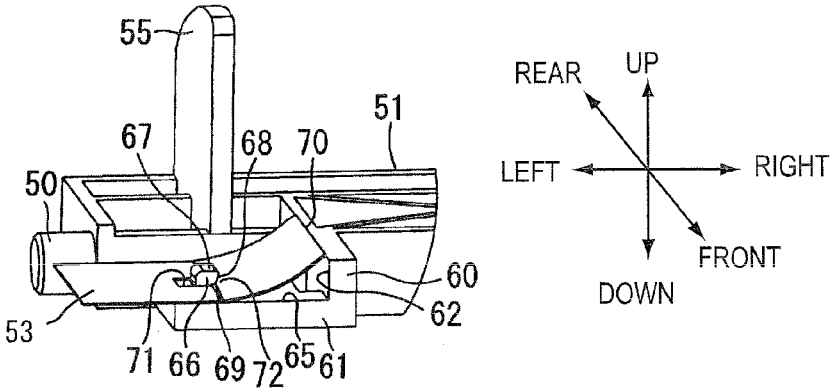
FIG. 6A is an enlarged perspective view of the fixing member, in which the wiper is about to be mounted on the fixing member.
Figure 7A:
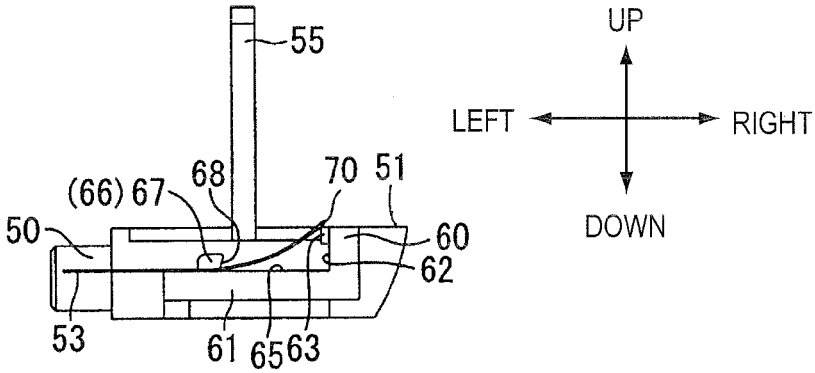
FIG. 7A is an enlarged elevation view of the fixing member, in which the wiper is about to be mounted on the fixing member.

First, the wiper 53 is arranged at a position above the fixing member 56. The wiper 53 is then moved down below so that, as shown in FIGS. 6A and 7A, the second protrusion 66 of the second fixing portion 61 can penetrate the slot 71 of the wiper 53. At this time, the right end 72 of the slot 71 is guided downward along the sloped surface 68 of the second protrusion 66. When the bottom surface of the wiper 53 comes into contact with the wiper placing surface 65, the right end 72 of the slot 71 enters the gap 69 formed between the sloped surface 68 and the wiper placing surface 65, whereby the right end 72 is brought into contact and engagement with the second protrusion 66. The right end 72 of the slot 71 thus serves as a second engaging section.

In this state, a right end portion of the wiper 53 contacts the first protrusion 63 from above. That is, a portion of the wiper 53 rightward of the second engaging section 72 (the right end 72 of the slot 71) extends to cover the first protrusion 63 while curved downward.

Figure 6B:
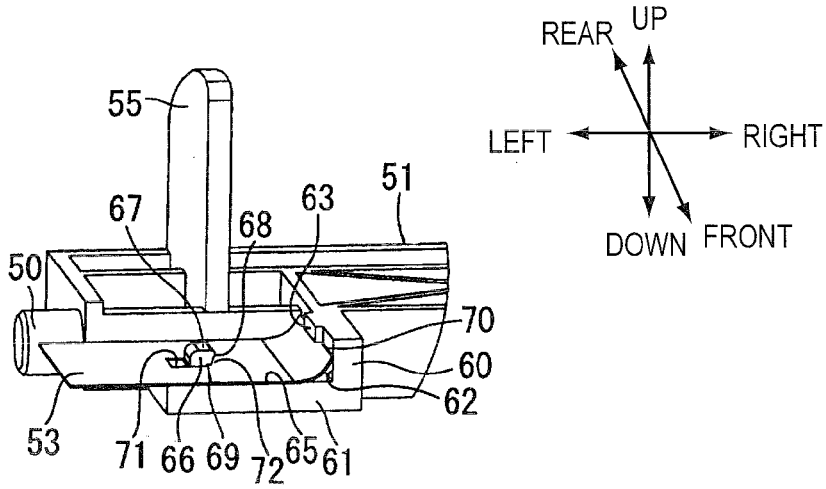
FIG. 6B is an enlarged perspective view of the fixing member, in which the wiper has been mounted on the fixing member.
Figure 7B:
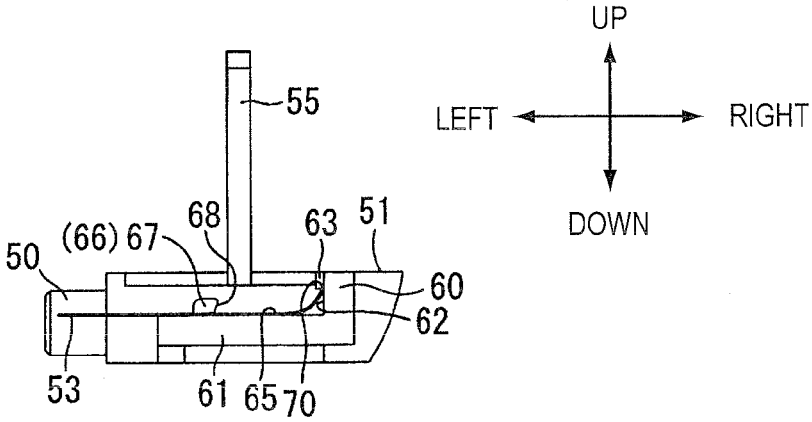
FIG. 7B is an enlarged elevation view of the fixing member, in which the wiper has been mounted on the fixing member.

Subsequently, a portion of the wiper 53 between the right end surface 70 and the second engaging section 72 is pressed toward the wiper engaging surface 62 as well as toward the wiper placing surface 65, thereby moving the right end surface 70 of the wiper 53 (i.e., the first engaging section 70) below the first protrusion 63, as shown in FIGS. 6B and 7B. In this state, the portion of the wiper 53 between the first engaging section 70 and the second engaging section 72 is further curved downward.

The wiper 53 has a resiliency. Because of the resiliency, the resiliently curved portion of the wiper 53 between the first engaging section 70 and the second engaging section 72 is urged to restore its linearity. This resilient force enables the first engaging section 70 (the right end surface 70) to be in pressure-contact with the first protrusion 63 from downward thereof, and simultaneously allows the second engaging section 72 to be in pressure-contact with the second protrusion 66 from rightward thereof. In this way, stabilized engagement between the first engaging section 70 and the first protrusion 63, and engagement between the second engaging section 72 and the second protrusion 66 can be provided. The wiper 53 is thus stably fixed to the fixing member 56, thereby improving positioning accuracy of the wiper 53 against the fixing member 56.

As described above, the first engaging section 70 is the right end surface 70 of the wiper 53. The wiper 53 is formed with the slot 71 that allows the second protrusion 66 to penetrate therethrough. The second engaging section 72 is the right end 72 of the slot 71. The right end surface 70 can be engaged with the first protrusion 63 after the second protrusion 66 is inserted into the slot 71 and the right end 72 of the slot 71 is brought into engagement with the second protrusion 66. The wiper 53 is thus mounted on the fixing member 56. Since the second protrusion 66 penetrates the slot 71, the slot 71 does not easily come off from the second protrusion 66 when the first engaging section 70 is brought into engagement with the first protrusion 63. Hence, the first engaging section 70 is allowed to engage the first protrusion 63 easily, thereby facilitating fixation of the wiper 53 onto the wiper placing surface 65.

The fixing member 56 is formed with the wiper engaging surface 62 which is orthogonal to the wiper placing surface 65. The first protrusion 63 protrudes from the wiper engaging surface 62. With this construction, the wiper 53 is allowed to be mounted on the fixing member 56 while curved along both the wiper placing surface 65 and the wiper engaging surface 62. Hence, the resilient force is reliably applied to the curved portion of the wiper 53 between the first engaging section 70 and the second engaging section 72, leading to steady engagement of the first engaging section 70 against the first protrusion 63.

The second protrusion 66 is formed in a hook shape having the hook 67. The hook 67 protrudes inward in the widthwise direction. The hook 67 restricts the second engaging section 72 from moving upward, thereby preventing the second engaging section 72 from being disengaged from the second protrusion 66.

The hook 67 is formed with the sloped surface 68 that slopes toward the wiper placing surface 65, i.e., a distance between the sloped surface 68 and the wiper placing surface 65 is gradually reduced toward a base end of the hook 67. Since guided along the sloped surface 68, the second engaging section 72 can easily engage the second protrusion 66.

Figure 8:
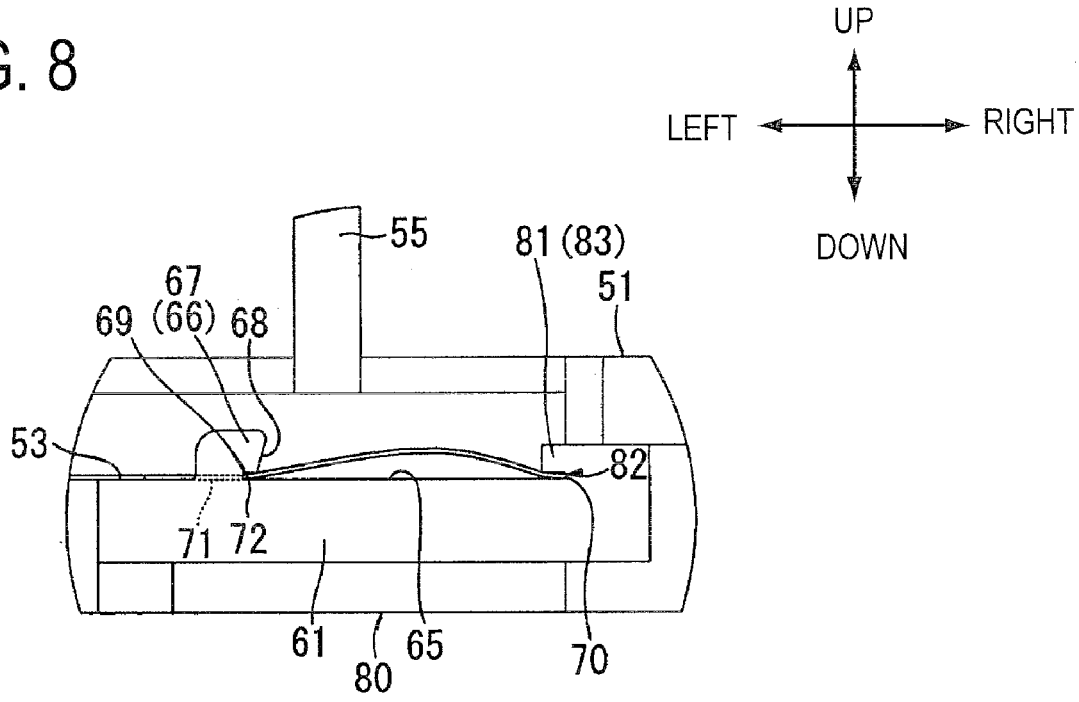
FIG. 8 is a partially enlarged view of an agitator according to a second embodiment of the present invention, taken along a plane parallel to a vertical direction as well as to a left-to-right direction.

Now, an agitator according to a second embodiment of the present invention will be described while referring to FIG. 8 wherein like parts and components are designated by the same reference numerals in order to avoid duplicating description.

A fixing member 80 according to the second embodiment is provided with a first protrusion 83 protruding upward from the wiper placing surface 65 of the second fixing portion 61. In the second embodiment, the fixing member 80 is not provided with a portion corresponding to the first fixing portion 60 of the first embodiment.

The first protrusion 83 is formed in a hook shape. More precisely, the first protrusion 83 is formed with an upper portion protruding leftward (i.e., outward in the widthwise direction), which serves as a hook 81. A gap 82 is formed between a bottom end of the hook 81 and the wiper placing surface 65 for engagement with the first engaging section 70.

Under this configuration, the wiper 53 is fixed to the fixing member 80 as follows. The wiper 53 is first arranged above the fixing member 80. The wiper 53 is then moved below so that the second protrusion 66 of the second fixing portion 61 can penetrate the slot 71 of the wiper 53 (illustrated by a dotted line in FIG. 8). At this time, the wiper 53 is moved downward while the sloped surface 68 of the second protrusion 66 guides the second engaging section 72 of the slot 71. When the bottom surface of the wiper 53 contacts the wiper placing surface 56, the second engaging section 72 enters the gap 69 formed between the sloped surface 68 and the wiper placing surface 65.

Subsequently, the portion of the wiper 56 between the first engaging section 70 and the second engaging section 72 is curved in a convex shape on the wiper placing surface 65 and inserted into the gap 82 from leftward. Accordingly, the first engaging section 70 is brought into contact with the first protrusion 83 from leftward and thus in engagement with the same, thereby completing fixation of the wiper 53 to the fixing member 80.

Alternatively, the first engaging section 70 may be inserted into the gap 82 before the second protrusion 66 is inserted into the slot 71. More specifically, after the wiper 53 is placed above the fixing member 80, the first engaging section 70 of the wiper 53 is inserted into the gap 82 from leftward. Subsequently, while the portion of the wiper 53 between the first engaging section 70 and the second engaging section 72 is then curved in a convex shape on the wiper placing surface 65, the second protrusion 66 of the second fixing portion 61 is inserted into the slot 71 of the wiper 53. At this time, the second engaging section 72 of the wiper 53 is guided along the sloped surface 68, thereby moving the wiper 53 downward. When the bottom surface of the wiper 53 is in contact with the wiper placing surface 56, the second engaging section 72 enters the gap 69. In this way, the wiper 53 is firmly fixed to the fixing member 80.

In this state, the portion of the wiper 53 between the first engaging section 70 and the second engaging section 72 is convexed upward. Hence, this curved portion of the wiper 53 generates resilient force, which allows the first engaging section 70 to be in pressure-contact with the first protrusion 83 from the left while allowing the second engaging section 72 to be in pressure-contact with the second protrusion 66 from the right. In this way, while the first engaging section 70 is in engagement with the first protrusion 83, the second engaging section 72 is brought into engagement with the second protrusion 66, thereby enabling the wiper 53 to be reliably fixed to the fixing member 80.

The first protrusion 83 is hook-shaped and formed with the hook 81. Hence, the first engaging section 70 is restricted from moving upward (i.e., in a direction that the first protrusion 83 protrudes), thereby preventing the first engaging section 70 from coming off from the first protrusion 83.

Although the present invention has been described with respect to specific embodiments, it will be appreciated by one skilled in the art that a variety of changes may be made without departing from the scope of the invention.

In the above embodiments, the wiper 53 is formed of a resiliently deformable material. However, the agitating blade 52 may be formed from a resiliently deformable material. In this case, the agitating blade 52 is formed with a first engaging section and a second engaging section, and the main body 51 is provided with a first protrusion and a second protrusion. The first engaging section and the second engaging section engage the first protrusion and the second protrusion respectively, thereby completing fixation of the agitating blade 52 to the main body 51.

As a further variation, the first protrusion 63 in the first embodiment may be formed in a hook shape as in the second embodiment. In this case, a gap is formed between the wiper engaging surface 62 and the hook portion of the first protrusion 63, whereby the first engaging section 70 can engage the first protrusion 63.

What is claimed is:

1. An agitator that agitates developer, comprising:

a main body having a placing surface, a first protrusion, and a second protrusion protruding from the placing surface; and a resiliently deformable plate-like member having a free end portion including a free end and a supported portion supported to the main body, the supported portion being placed on the placing surface and having a first engaging section engaging the first protrusion and a second engaging section engaging the second protrusion, the supported portion being curved upon resilient deformation thereof as a result of engagement of the first engaging section and the second engaging section with the first protrusion and the second protrusion respectively, a length between the first engaging section and the second engaging section being greater than a linear distance between the first protrusion and the second protrusion.

2. The agitator as claimed in claim 1, wherein the first engaging section is another end of the plate-like member opposite to the free end of the free end portion.

3. The agitator as claimed in claim 2, wherein the supported portion is formed with a slot through which the second protrusion penetrates, the slot having a first end closer to the free end and a second end closer to the first engaging section and functioning as the second engaging section.

4. The agitator as claimed in claim 1, wherein the main body has an engaging surface extending in a direction perpendicular to the placing surface, the first protrusion protruding from the engaging surface.

5. The agitator as claimed in claim 4, wherein the first protrusion protrudes toward the free end and has a first engagement surface facing the placing surface, the first engaging section being engaged with the first engagement surface.

6. The agitator as claimed in claim 1, wherein the first protrusion protrudes from the placing surface and has a notched portion defining a hooked portion orienting toward the free end, the first engaging section being engaged with the notched portion.

7. The agitator as claimed in claim 1, wherein the second protrusion has a base end connected to the placing surface and a hooked portion orienting toward the first protrusion.

8. The agitator as claimed in claim 7, wherein the hooked portion has a slant guide surface facilitating engagement of the second engaging section with the second protrusion.

9. The agitator as claimed in claim 1, wherein the plate-like member is formed of a synthetic resin.

10. A developing cartridge that accommodates developer, the developing cartridge comprising:

a casing that accommodates the developer; and an agitator disposed within the casing for agitating the developer, the agitator comprising:

a main body having a placing surface, a first protrusion, and a second protrusion protruding from the placing surface; and, a resiliently deformable plate-like member having a free end portion including a free end and a supported portion supported to the main body, the supported portion being placed on the placing surface and having a first engaging section engaging the first protrusion and a second engaging section engaging the second protrusion, the supported portion being curved upon resilient deformation thereof as a result of engagement of the first engaging section and the second engaging section with the first protrusion and the second protrusion respectively, a length between the first engaging section and the second engaging section being greater than a linear distance between the first protrusion and the second protrusion.

11. The developing cartridge as claimed in claim 10, wherein the casing has a window that allows light to transmit therethrough for detecting remaining amounts of the developer accommodated in the casing.

12. The developing cartridge as claimed in claim 11, wherein the agitator is rotatably supported to the casing; and wherein the free end portion of the plate-like member functions as a wiper that wipes the window when the agitator rotates.

* * * * *